US007015873B1

(12) United States Patent
Talley

(10) Patent No.: US 7,015,873 B1
(45) Date of Patent: Mar. 21, 2006

(54) THERMALLY DISSIPATING HIGH RF POWER RADIATING ANTENNA SYSTEM

(75) Inventor: Eric Talley, Hamilton, NJ (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 10/864,346

(22) Filed: Jun. 10, 2004

(51) Int. Cl.
*H01Q 1/36* (2006.01)

(52) U.S. Cl. ..... 343/895; 343/788; 343/742; 343/727

(58) Field of Classification Search ..... 343/895, 343/788
See application file for complete search history.

(56) References Cited

U.S. PATENT DOCUMENTS 4,119,970 A * 10/1978 Bogner et al. ..... 343/727
4,320,246 A 3/1982 Russell
4,519,384 A 5/1985 Murtha
5,625,370 A * 4/1997 D'Hont ..... 343/788
5,660,644 A 8/1997 Clemens
5,734,353 A * 3/1998 Van Voorhies ..... 343/742
5,979,834 A 11/1999 Falbel
6,011,524 A * 1/2000 Jervis ..... 343/895
6,118,067 A 9/2000 Lashley et al.
6,172,655 B1 * 1/2001 Volman ..... 343/895
2004/0108967 A1 * 6/2004 Fujimura et al. ..... 343/895

* cited by examiner

*Primary Examiner*—Binh Van Ho
(74) *Attorney, Agent, or Firm*—McDermott Will & Emery

(57) ABSTRACT

A high power radiating antenna system is disclosed which includes a ground plane and an electrically conductive power radiating element. The power radiating element includes a first, power feed end proximal to the ground plane and a second end distal to the ground plane. The power radiating element further includes an integrally formed heat pipe adapted for dissipating thermal energy generated in the power radiating element during operation of the antenna system.

20 Claims, 3 Drawing Sheets

THERMALLY DISSIPATING HIGH RF POWER RADIATING ANTENNA SYSTEM

FIELD OF THE DISCLOSURE

The disclosure relates to high RF power radiating antennas and systems with integral heat pipe thermal dissipating means. The disclosure has particular utility with helical RF power radiating antenna systems utilized in space-based applications.

BACKGROUND DISCUSSION

The escalating requirements for system capacity and higher gain over larger coverage areas have necessitated a corresponding increase in RF power transmission requirements of space-based antenna systems.

A high RF power radiating antenna suitable for use in an extraterrestrial environment is disclosed in commonly assigned U.S. Pat. No. 6,172,655 B1. Referring to FIGS. 1 (A) and 1 (B), the antenna 10 system disclosed therein includes a winding 12, a ground plane 14, and a coaxial feed. As illustrated, winding 12 includes an electrical conductor 20 helically wound about an axis 8 oriented orthogonal to a ground plane 14. Conductor 20 may be in the form of a solid or tubular (i.e., hollow) wire, or ribbon-shaped, etc., and typically is comprised of aluminum, copper, or an alloy thereof. Conductor 20 includes a first, or lower, end adjacent the ground plane 14 and a second, or upper, end remote from the ground plane 14. The antenna winding 12 is helically configured and includes a first, or lower, portion 22 and a second, or upper, portion 24. As illustrated, conductor 20 is formed as a single, continuous element, the first, or lower, and second, or upper portions 22 and 24 are immediately adjacent to each other and connect at location 28. The first, or lower, portion 22 of antenna winding 12, helically configured conductor 20 extends between planes 31 and 32 and is wound with a pitch angle $\alpha$ relative to plane 31 parallel to the upper surface of ground plane 14. The second, or upper portion 24 of antenna winding 12 extends between planes 32 and 33, includes upper (or distal) end 30, and the helically configured conductor 20 is wound in this portion with a pitch angle $\beta$ relative to plane 32 which is parallel to plane 31 and includes location 28. As is evident from the figures, pitch angle $\beta$ is greater than pitch angle $\alpha$, i.e., the first, or lower, portion 22 of the helically configured conductor 20 is more tightly wound than the second, or upper, portion 24. The first, or lower, portion 22 of conductor 20 is wound or defined on the "surface" 41 of a section or segment of a first cone 41*c*, which cone segment is centered on axis 8, has its smaller diameter D1 coincident with plane 31 and its larger diameter D2 coincident with plane 32. The second, or upper, portion 24 of conductor 20 is wound or defined on the "surface" 42 of a second cone 42*c*, which cone segment is also centered on axis 8, has its smaller diameter D3 coincident with plane 33 and its larger diameter D2 coincident with plane 32. As is also evident from the figures, second cone 42*c* extends for a longer distance along central axis 8 than first cone 41*c*.

Also as illustrated, feed end 26 of antenna winding 12 is connected the upper end of a center conductor 16*c* associated with coaxial feed 16. Antenna winding 12 is thus electrically insulated from ground plane 14.

RF power loss within the antenna element, especially at higher power levels, results in a local temperature increase within the RF radiating element, the temperature increase being greatest in the first, or lower, portion 22 proximal the interacting, RF reflecting ground plane 14 or other radiating structure. For example, depending upon the RF activating power, a temperature gradient of up to about 100° C. may be created between the first, or lower, portion 22 (i.e., the RF power feed portion) adjacent the ground plane 14 and the second, or upper, portion 24. Since the RF-generated thermal energy cannot be fully dissipated by the RF radiating element (e.g., of aluminum, copper, copper-plated aluminum, or other electrically conductive material or alloy), the localized heating and temperature differential can result in an excessively high temperature condition within the RF radiating element and/or supporting structure. Thus, operating temperatures can exceed the capability of the material(s) of the RF radiating element and/or the supporting structure.

Conventional approaches for providing heat sinking for mitigating negative effects arising from RF power loss in radiating elements in space vacuum environments typically involve thermal dissipation via conduction and radiation. Currently, such approaches rely upon thermal conduction along the RF radiating element, thermal conduction into the structural support, and direct thermal radiation from the radiating element to the space environment. One such approach comprises adding a thermally conductive dielectric material in the region of high RF loss of the radiating element and conductively coupling the material to the radiating element. Such arrangement can locally dissipate thermal energy generated from RF losses from the radiating element, providing there is intimate contact between the RF radiating element and a substantial mass or large area (e.g., an antenna ground plane) acting as a heat sink. In this instance, the thermal energy is transferred by conduction into the thermally conductive dielectric material and then into the mass (i.e., the ground plane in this example). However, this approach incurs a disadvantageous consequence in that the thermally conductive dielectric material has a negative effect on the RF matching of the antenna. According to another conventional approach, the size of the RF radiating element, e.g., the diameter, is increased, resulting in an increase in the thermal radiating area. However, the effect of the increase in the size of the RF radiating element must be considered when designing the antenna.

In view of the foregoing, there exists a clear need for improved means and methodology for mitigating the above-described problems, disadvantages, and drawbacks associated with the conventional approaches for providing dissipation of thermal energy arising from energy losses in radiating elements, e.g., RF radiating antennas, which means and methodology are fully compatible with the requirements for high RF power space-based or terrestrial applications.

SUMMARY OF THE DISCLOSURE

An advantage of the present disclosure is an improved high power radiating antenna system.

Another advantage is an improved high RF transmitting power radiating antenna system.

Yet another advantage is an improved thermal energy dissipating, high power radiating antenna system suitable for use in space-based or terrestrial environments and applications.

Additional advantages and other features of the present disclosure will be set forth in the description which follows and in part will become apparent to those having ordinary skill in the art upon examination of the following or may be learned from the practice of the present invention. The advantages of the present disclosure may be realized and obtained as particularly pointed out in the appended claims.

According to an aspect of the present disclosure, the foregoing and other advantages are obtained in part by a high power radiating antenna system, comprising:

(a) a ground plane; and (b) an electrically conductive power radiating element having a first, power feed end proximal the ground plane and a second end distal the ground plane, the elongated power radiating element comprising an integrally formed heat pipe adapted for dissipating thermal energy generated in the power radiating element during operation of the antenna system.

According to preferred embodiments, the electrically conductive power radiating element comprises an elongated tube having an interior wall, the tube being sealed at the first, power feed end and at the second end; elongated tube comprises a thermally conductive material, e.g., a thermally conductive metal material selected from the group consisting of aluminum, aluminum alloys, copper, and copper alloys, or a thermally conductive composite material selected from the group consisting of aluminum clad tubing, aluminum alloy clad tubing, copper clad tubing, and copper alloy clad tubing; the first, power feed end of said tubular power radiating comprises a reservoir containing a phase change liquid, i.e., a vaporizable liquid, e.g., selected from the group consisting of ammonia, acetone, toluene, water, fluorocarbons, alcohols, sulfur-oxygen compounds, pentane, hexane, and other hydrocarbons; the interior wall of the tubular power radiating element is provided with a plurality of longitudinally extending channels for directing a flow of the vaporizable liquid back to the reservoir after condensation of vapors of the liquid along cooler portions of the heat pipe spaced from the first, power feed end; and the tubular power radiating element has a circular-shaped cross-section and the plurality of longitudinally extending, flow directing channels comprise a plurality of longitudinally elongated ribs extending radially inwardly from the interior wall.

Additional preferred embodiments include those wherein the antenna system further comprises:

(c) a coaxial RF power feed extending through an opening in the ground plane and electrically connected to the first, power feed end of the electrically conductive power radiating element.

According to still other preferred embodiments, the electrically conductive power radiating element is helically wound about a central axis; the electrically conductive power radiating element comprises a first helically wound portion proximal the ground plane and including the first, power feed end, and a second helically wound portion distal the ground plane and including the second end; and the first and second helically wound portions of the electrically conductive power radiating element are wound with respective first and second pitch angles $\alpha$ and $\beta$ relative to planes parallel to the ground plane, wherein the second pitch angle $\beta$ is greater than the first pitch angle $\alpha$, whereby the first helically wound portion of the electrically conductive power radiating element is wound more tightly than the second helically wound portion of the electrically conductive power radiating element.

In accordance with still further preferred embodiments, the electrically conductive power radiating element comprises a dual-tapered helix, wherein first and second helically wound portions of the electrically conductive power radiating element define oppositely facing, respective first and second cone-shaped segments which abut at their common, larger diameter ends; and the second cone-shaped segment extends for a greater length along the central axis than the first cone-shaped segment.

Preferred embodiments include those wherein the antenna system further comprises:

(d) a support for the electrically conductive power radiating element, e.g., wherein the electrically conductive power radiating element is wound about a longitudinally extending central axis and the support for the electrically conductive power radiating element is positioned interiorly of the electrically conductive power radiating element and along the central axis.

According to still other preferred embodiments, the electrically conductive power radiating element is electrically isolated from the ground plane; and the antenna system further comprises:

(e) an electrically insulative support for the ground plane, e.g., an RF connector or an electromagnetic coupling.

Additional advantages and aspects of the disclosure will become readily apparent to those skilled in the art from the following detailed description, wherein embodiments of the present invention are shown and described, simply by way of illustration of the best mode contemplated for practicing the present invention. As will be described, the disclosure is capable of other and different embodiments, and its several details are susceptible of modification in various obvious respects, all without departing from the spirit of the disclosure. Accordingly, the drawings and description are to be regarded as illustrative in nature, and not as limitative.

BRIEF DESCRIPTION OF THE DRAWINGS

The following detailed description of the embodiments of the present disclosure can best be understood when read in conjunction with the following drawings, in which the various features are not necessarily drawn to scale but rather are drawn as to best illustrate the pertinent features and the same reference numerals are employed throughout for designating similar features, wherein:

FIG. 1 (B) is a simplified sectional view of the antenna system of FIG. 1 (B);

DETAILED DESCRIPTION OF THE INVENTION

Figure 1A:
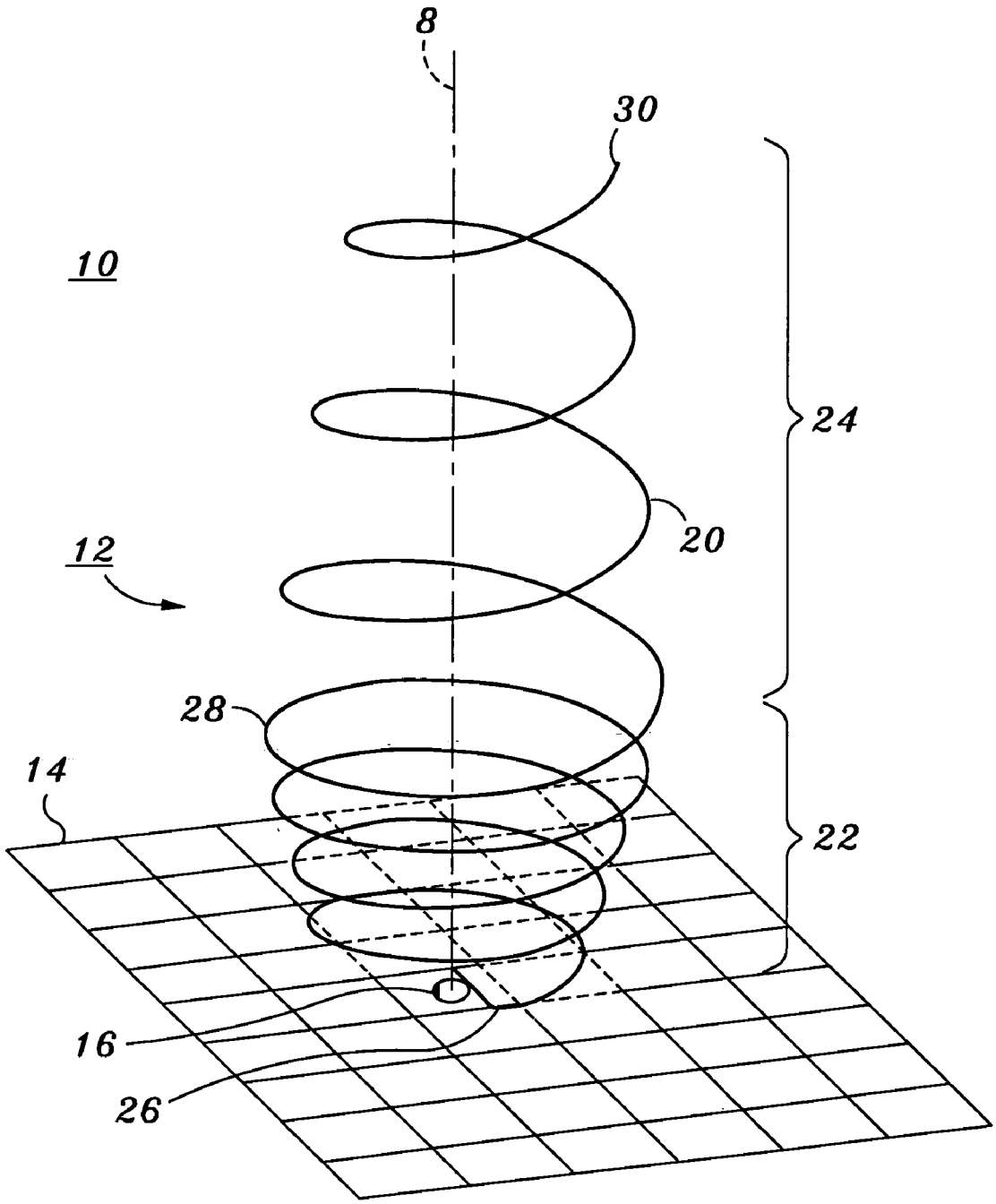
FIG. 1A (PRIOR ART)
FIG. 1 (A) is a simplified perspective (or isometric) view of an antenna system according to that disclosed in commonly assigned U.S. Pat. No. 6,172,655 B1, including an antenna winding, ground plane, and power feed.

The present disclosure addresses and effectively solves, or at least mitigates, the above-described problems and difficulties associated with deleterious generation of elevated temperatures in radiators of electromagnetic radiation such as RF antennas and systems, and is based upon recognition by the inventors of the benefits obtained by configuring the radiating element in the form of a heat pipe providing an effective cooling means integral with the radiating element.

According to the disclosure, the use of a radiating element, e.g., an RF radiating element, with an integrally formed heat pipe affords a number of advantages not attainable by means of the conventional technology described supra, and includes the following:

use of an integral heat pipe with high power radiating elements, e.g., helical RF radiating elements, provides a substantial reduction of element operating temperatures vis-à-vis similarly configured element designs without integrally formed heat pipes;

integrally formed heat pipes provide a path for highly effective thermal energy dissipation which extends along the entire length of the radiating element;

fabrication of radiating elements comprising integrally formed heat pipes is readily accomplished utilizing existing technologies;

the technology for forming radiating elements with integrally formed heat pipes can be applied to radiating elements operating within various RF frequency bands by appropriate selection of the outer dimension, e.g., outer diameter (OD), of the radiating element/heat pipe; and micro-dimensioned radiating elements/heat pipes can be utilized in applications where the OD of the heat pipe is required to be smaller than in conventional heat pipe designs.

According to the disclosure, therefore, the radiating element of an antenna or antenna system is configured as a longitudinally extending tubular structure having a hollow central portion extending for the length of the tube, and with a predetermined thickness between the inner and outer walls. The tubular radiating element is formed of an electrically and thermally conductive material, typically aluminum or an aluminum alloy, although other electrically and thermally conductive metal materials may also be utilized, e.g., copper, copper alloys, as well as thermally conductive composite materials, e.g., aluminum or aluminum alloy clad tubing and copper or copper alloy clad tubing (i.e., reinforced composite tubing including an internal non-permeable barrier, e.g., of aluminum, copper, or a metal alloy). Fabrication methods which can be utilized for forming the tubular radiating element include extrusion, pultrusion, and machining. According to a feature of the invention, the internal and/or external cross-section of the tubular radiating element is not critical, and therefore may, for example, be circular, oval, rectangular, or square. In addition, the inner and outer wall surfaces may be either smooth or provided with fins or other protrusions for increasing the surface area, hence the thermal radiating ability of the radiating element. Preferably, the inner wall of the tubular radiating element is provided with a plurality of longitudinally extending fins defining a plurality of channels for facilitating fluid flow therein from a cooler end to a warmer end. For example, a tubular radiating element having a circular inner cross-section is preferably provided with a plurality of radially inwardly extending fins along the entire length thereof for defining the fluid-directing channels.

According to the disclosure, the width of the tubular radiating element is selected for use according to the intended application. For example, when the radiating element is utilized with RF frequencies within the S-band (1.9 GHz), the width may range from about 0.08 in. to about 0.09 in., whereas, when the radiating element is utilized with RF frequencies within the UHF band, the width may range from about 0.375 in. to about 0.5 in.

Figure 1B:
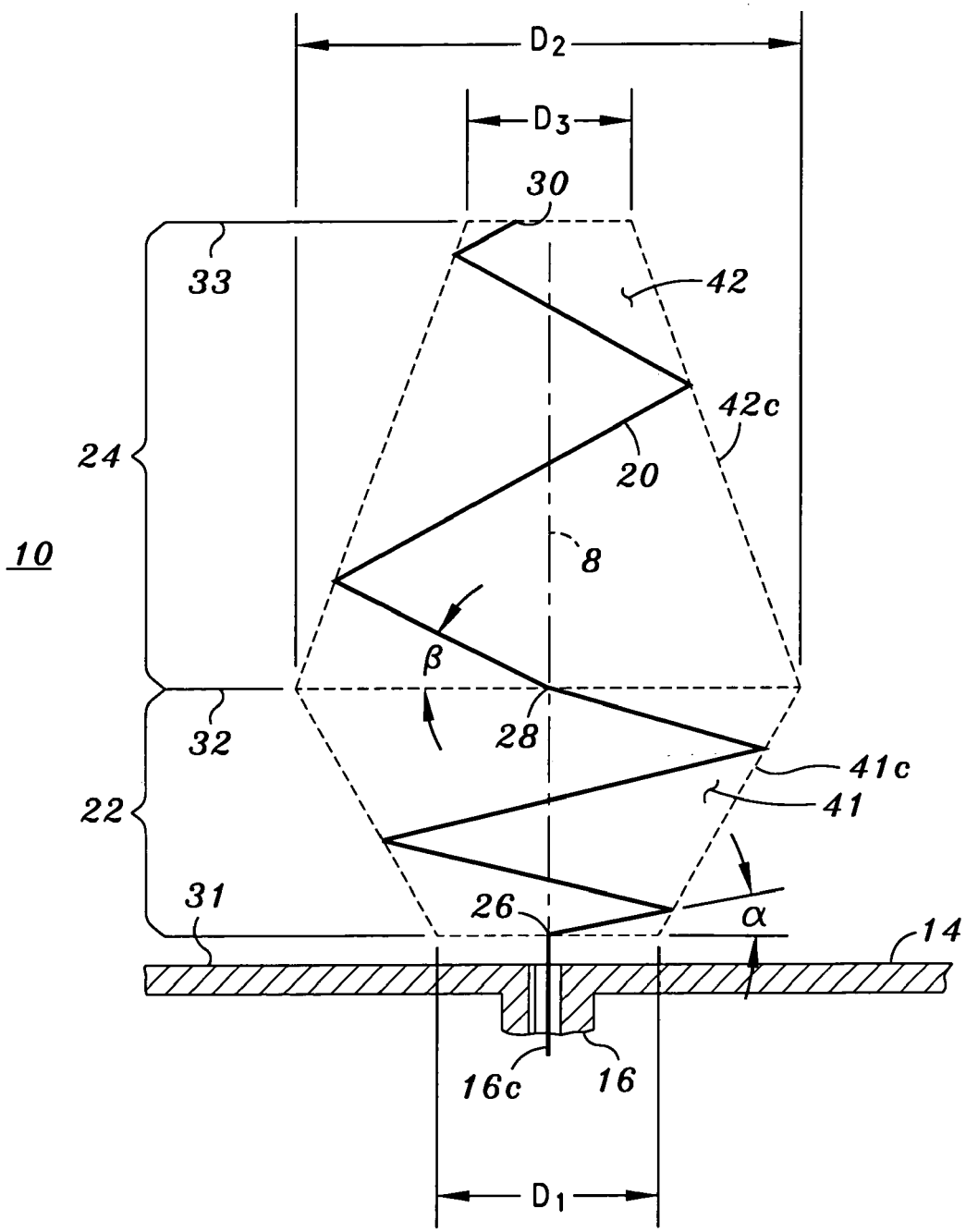
FIG. 1B (PRIOR ART)

In a typical fabrication sequence, the tubular radiating element is formed, as by mechanical or other conventional means, into a desired configuration, e.g., a dual helix configuration as illustrated in FIGS. 1 (A)–1 (B); the interior hollow space of the thus-provided tubular radiating element is cleaned of contaminants, moisture and atmospheric gas are removed therefrom; the tubular element is supplied with a predetermined amount of phase change material for filling a reservoir at one end thereof, e.g., a vaporizable liquid selected for compatibility with the intended operating temperature of the antenna, typically selected from the group consisting of: ammonia, acetone, toluene, water, fluorocarbons, alcohols, sulfur-oxygen compounds, pentane, hexane, and other hydrocarbons; and the ends of the tubular element are hermetically sealed in conventional manner.

The thus-fabricated, hermetically sealed radiating element includes an integrally formed heat pipe capable of providing a substantial improvement in thermal conductivity (relative to conventional cooling or heat sinking technology) along the entire length of the energy radiating element. In operation of the inventive energy radiating element, thermal energy generated due to localized energy loss, e.g., loss of RF energy localized at the lower end or portion of the above-described dual helix radiating element, causes the vaporizable fluid contained in the collector region (adjacent the reservoir) at the lower end or portion of the radiating element to vaporize, extracting the necessary heat of vaporization from the section of the radiating element experiencing the greatest loss in RF energy. The expanding vapor then travels to the upper, cooler portion(s) of the RF radiating element, where the vapor condenses back to liquid, thereby releasing the thermal energy stored therein (i.e., the heat of vaporization), which released thermal energy is dissipated to the surrounding environment by thermal conduction and radiation. The condensed fluid travels back to the lower, warmer portion of the radiating element via capillary action, assisted by the liquid channeling action provided by the longitudinally extending ribs protruding from the inner wall of the tubular element. The vaporization process is repeated at the lower, warmer portion of the radiating element so as to provide continuous removal of excess RF-generated thermal radiation therefrom.

Thus, by integrally incorporating a heat pipe in the radiating element according to the invention, localized "hot spots" are eliminated and the peak temperature along the radiating element dramatically reduced. An even greater amount of thermal energy dissipation is obtainable by treating the exterior surface(s) of the radiating element with a paint or other coating, e.g., a chemical conversion coating, for increasing the thermal emissivity of the radiating element. As a consequence, according to the invention, the (RF) energy radiating antenna element becomes an efficient thermal radiating surface for substantially its entire length, by which thermal energy is conducted away from the element and radiated to the environment.

Figure 2:
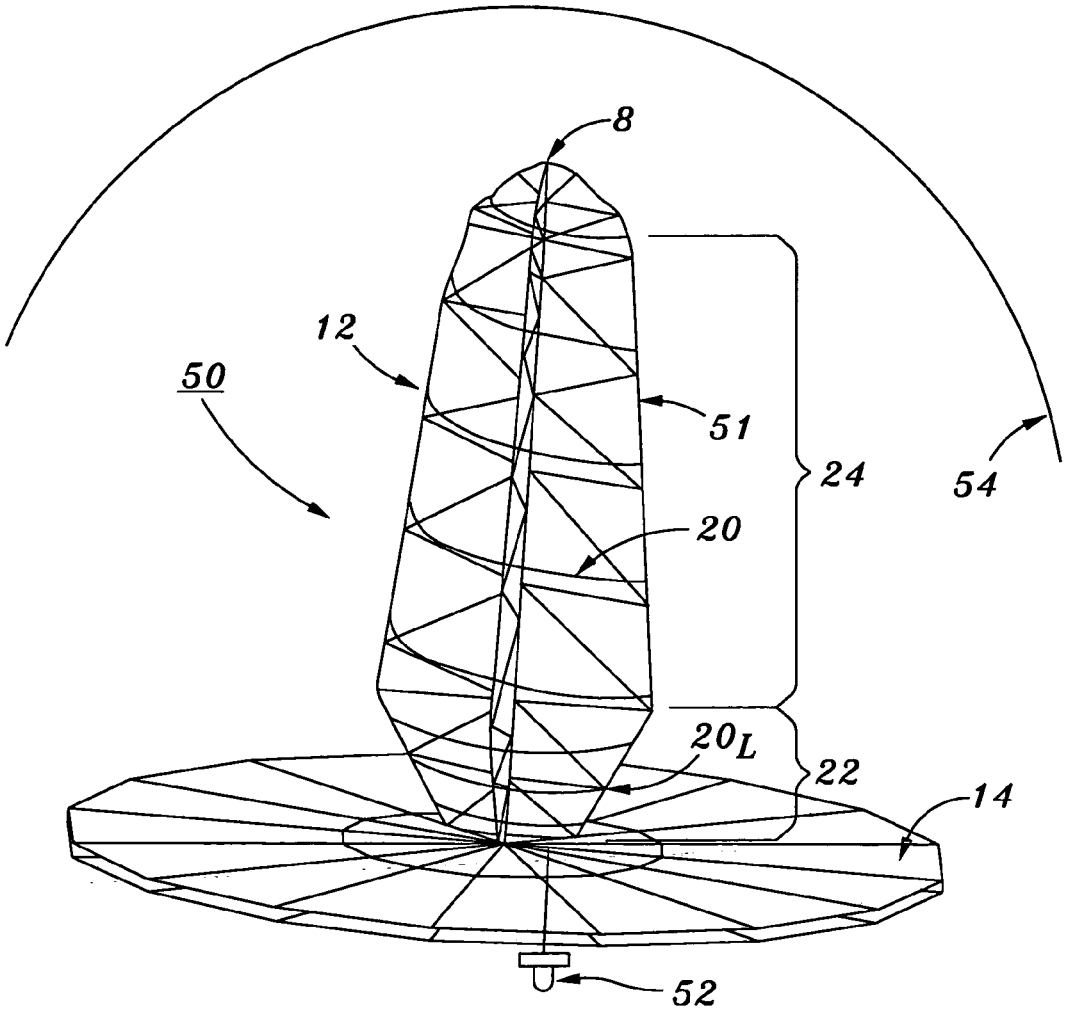
FIG. 2 is a simplified perspective view of an antenna system according to a preferred embodiment of the present disclosure.

Referring now to FIG. 2, shown therein, is a simplified perspective view of an antenna system 50 according to an illustrative, but not limitative, embodiment of the disclosure. As illustrated, system 50 is similar to system 10 shown in FIGS. 1 (A)–1 (B) and comprises a radiating element/heat pipe 20 formed of a tubular, electrically and thermally conductive material configured as a dual helix 12 wound around a non-conductive support structure 51 and including a first, or lower, portion 22 proximal a ground plane 14 and a second, or upper, portion 24 distal the ground plane, wherein the helical spiral of the first, or lower, portion 22 is more tightly wound spiral than that of the second, or upper portion. As before, the first and second portions define respective first, or lower, and second, or upper, conical-shaped segments centered about a common axis 8, wherein their respective larger diameters are in abutting relation and the second, or upper, conical-shaped segment extends for a greater distance along the common axis than the first, or lower, conical-shaped segment. As indicated above, radiating element/heat pipe 20 is hermetically sealed at both ends and at least the lowermost coils $\mathbf{20}_L$ of the first, or lower, portion 22 form a reservoir for the vaporizable liquid enabling operation as a heat pipe. Finally, system 50 includes an electrically insulated RF connector 52 below ground plane 14 and a sunshield 54.

Figure 3:
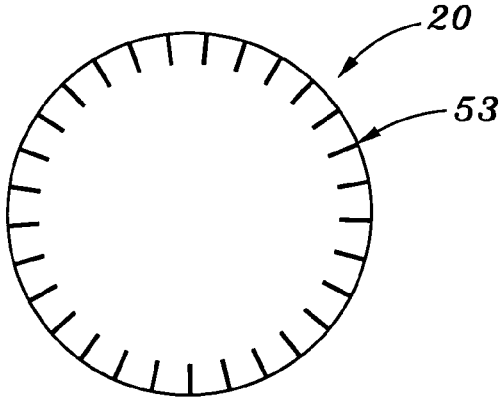
FIG. 3 is a simplified sectional view of a heat pipe utilizing a circularly-shaped tube according to a preferred embodiment of the disclosure.

Adverting to FIG. 3, shown therein is a simplified sectional view of the radiating element/heat pipe 20 of the embodiment shown in FIG. 2, wherein radiating element/heat pipe 20 is in the form of a tube having a circular cross-sectional configuration, and includes a plurality of longitudinally elongated protrusions or fins 53 extending radially inwardly from the inner wall for defining a plurality of channels for facilitating flow of condensed vapor from the second, or upper, portion 24 of the dual helix structure 12 back to the first, or lower, portion 22 where thermal generation via loss of RF energy is greatest.

Simulations of several operational scenarios have confirmed that the operating temperatures of the RF radiating helix at various applied RF power levels are considerably lower when the integral heat pipe is operational than when the heat pipe is not operational (i.e., in a failure state). Further, the effect of the increased thermal dissipation afforded by the integral heat pipe has been determined to be substantially limited to the radiating helix, i.e., the component of the antenna system most likely to experience excessive heating due to RF losses.

Thus, by integrally incorporating a heat pipe into the (RF) energy radiating structure (helix), thermal energy management of the antenna can be achieved by means of a self-contained, self thermal regulating system. As a consequence, the need for use of conductive adhesives or provision of a clamping means for maintaining adjacent parts in intimate, thermally conductive contact at hot spots or areas, as in prior practice, is eliminated according to the present invention. Further, operation of the integral heat pipe of the present invention is not affected by quality issues pertaining to workmanship during assembly of the antenna system, as for example, leading to adhesion failure of thermal dissipating or heat sinking components. Stated differently, the inventive integral heat pipe technology is not sensitive to improper surface preparation, thermal stresses, loss of pre-load pressure between the RF radiating element and the thermally conductive path, and misalignment between conductive surfaces associated with conventional practices. In addition, use of bonded high mass, thermally conductive, dielectric material (inimical to space-based applications requiring low weight) is avoided according to the inventive technology. Finally, the inventive concept is not limited to use with space-based antenna systems but rather may be employed with all manner of terrestrial radiating antennas and systems in similar fashion.

In the previous description, numerous specific details are set forth, such as specific materials, structures, processes, etc., in order to provide a better understanding of the present disclosure. However, the present disclosure can be practiced without resorting to the details specifically set forth herein. In other instances, well-known processing techniques and structures have not been described in order not to unnecessarily obscure the present disclosure.

Only the preferred embodiments and but a few examples of its versatility are shown and described. It is to be understood that the present disclosure is capable of use in various other combinations and environments and is susceptible of changes and/or modifications within the scope of the inventive concepts as expressed herein.

What is claimed is:

1. A high power radiating antenna system, comprising:

(a) aground plane; and (b) an electrically conductive power radiating element having a first, power feed end proximal said ground plane and a second end distal said ground plane, said elongated power radiating element comprising an integrally formed heat pipe adapted for dissipating thermal energy generated in said power radiating element during operation of said antenna system, wherein said power radiating element comprises an elongated tube having an interior wall, said tube being sealed at said first, power feed end and at said second end.

2. The antenna system according to claim 1, wherein:

said elongated tube comprises a thermally conductive material.

3. The antenna system according to claim 2 wherein:

said elongated tube comprises a thermally conductive metal material selected from the group consisting of aluminum, aluminum alloys, and copper alloys, or a thermally conductive composite material selected from the group consisting of aluminum clad tubing, aluminum alloy clad tubing, copper clad tubing, and copper alloy clad tubing.

4. The antenna system according to claim 1, wherein:

said first, power feed end of said tubular power radiating element comprises a reservoir containing a vaporizable liquid.

5. The antenna system according to claim 4, wherein:

said vaporizable liquid is selected from the group consisting of ammonia, acetone, toluene, water, fluorocarbons, alcohols, sulfur-oxygen compounds, pentane, hexane, and other hydrocarbons.

6. The antenna system according to claim 4, wherein:

the interior wall of said tubular power radiating element is provided with a plurality of longitudinally extending channels for directing a flow of said vaporizable liquid back to said reservoir after condensation of vapors of said liquid along cooler portions of said heat pipe spaced from said first, power feed end.

7. The antenna system according to claim 6, wherein:

said tubular power radiating element has a circular-shaped cross-section and said plurality of longitudinally extending, flow directing channels comprise a plurality of longitudinally elongated ribs extending radially inwardly from said interior wall.

8. The antenna system according to claim 1, further comprising:

(c) a coaxial RF power feed extending through an opening in said ground plane and electrically connected to said first, power feed end of said electrically conductive power radiating element.

9. The antenna system according to claim 1, wherein:

said electrically conductive power radiating element is helically wound about a central axis.

10. The antenna system according to claim 9, wherein:

said electrically conductive power radiating element comprises a first helically wound portion proximal said ground plane and including said first, power feed end, and a second helically wound portion distal said ground plane and including said second end.

11. The antenna system according to claim 10, wherein:

said first and second helically wound portions of said electrically conductive power radiating element are wound with respective first and second pitch angles $\alpha$ and $\beta$ relative to planes parallel to said ground plane.

12. The antenna system according to claim 11, wherein:

said second pitch angle $\beta$ is greater than said first pitch angle $\alpha$, whereby said first helically wound portion of said electrically conductive power radiating element is wound more tightly than said second helically wound portion of said electrically conductive power radiating element.

13. The antenna system according to claim 10, wherein:

said electrically conductive power radiating element comprises a dual-tapered helix.

14. The antenna system according to claim 13, wherein:

said first and second helically wound portions of said electrically conductive power radiating element define oppositely facing, respective first and second cone-shaped segments which abut at their common, larger diameter ends.

15. The antenna system according to claim 14, wherein:

said second cone-shaped segment extends for a greater length along said central axis than said first cone-shaped segment.

16. The antenna system according to claim 1, further comprising:

(d) a support for said electrically conductive power radiating element.

17. The antenna system according to claim 16, wherein:

said electrically conductive power radiating element is wound about a longitudinally extending central axis and said support for said electrically conductive power radiating element is positioned interiorly of said electrically conductive power radiating element and along said central axis.

18. The antenna system according to claim 1, wherein:

said electrically conductive power radiating element is electrically isolated from said ground plane.

19. The antenna system according to claim 1, further comprising:

(e) an electrically insulative support for said ground plane.

20. The antenna system according to claim 18, wherein:

said support for said ground plane comprises an RF connector or an electromagnetic coupling.

* * * * *

UNITED STATES PATENT AND TRADEMARK OFFICE

CERTIFICATE OF CORRECTION

PATENT NO. : 7,015,873 B1
APPLICATION NO. : 10/864346
DATED : March 21, 2006
INVENTOR(S) : Eric Talley It is certified that error appears in the above-identified patent and that said Letters Patent is hereby corrected as shown below:

IN THE CLAIMS

Claim 1, column 7, line 67, "aground" should read --a ground--.

Signed and Sealed this

Twelfth Day of September, 2006

JON W. DUDAS
*Director of the United States Patent and Trademark Office*